US007839099B2

(12) United States Patent
Ball et al.

(10) Patent No.: US 7,839,099 B2
(45) Date of Patent: Nov. 23, 2010

(54) LED CONTROL CIRCUIT AND METHOD THEREFOR

(75) Inventors: Alan R. Ball, Gilbert, AZ (US); Stephen P. Robb, Fountain Hills, AZ (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 1265 days.

(21) Appl. No.: 11/399,523

(22) Filed: Apr. 7, 2006

(65) Prior Publication Data

US 2007/0236158 A1 Oct. 11, 2007

(51) Int. Cl.
*G05F 1/00* (2006.01)

(52) U.S. Cl. ..... 315/307; 345/82; 345/84; 345/102

(58) Field of Classification Search ..... 345/82, 345/84, 102; 315/170–176, 307
See application file for complete search history.

(56) References Cited

U.S. PATENT DOCUMENTS 6,400,349 B1 * 6/2002 Nagumo ..... 345/82
6,798,152 B2 * 9/2004 Rooke et al. ..... 315/209 R
7,466,082 B1 * 12/2008 Snyder et al. ..... 315/200 A
2003/0025465 A1 * 2/2003 Swanson et al. ..... 315/291
2004/0212321 A1 * 10/2004 Lys et al. ..... 315/291
2006/0001613 A1 * 1/2006 Routley et al. ..... 345/76

OTHER PUBLICATIONS

Data Sheet, "High-Efficiency Step-Up Converters for White LED Main and Subdisplay Backlighting, MAX1582/MAS1582Y", Maxim Integrated Products, #19-2783; Rev 2; Aug. 2005, copyright 2005, 10 pps.
Data Sheet, "FAN5611/FAN5612/FAN5613/FAN5614 Low-Drop-out LED Drivers for White, Blue or any Color LED", Fairchild Semiconductor, Rev. 1.0.4 Jun. 4, 2004, copyright 2004, 12 pps.

* cited by examiner

*Primary Examiner*—Quan-Zhen Wang
*Assistant Examiner*—Sahlu Okebato
(74) *Attorney, Agent, or Firm*—Robert F. Hightower

(57) ABSTRACT

In one embodiment, an LED control circuit is configured control a current through an LED responsively to a value that is proportional to a control signal for values of the control signal that are less than a threshold value of the control signal and to control the current to a value that is proportional to the threshold value for values of the control signal that are greater than the threshold value.

18 Claims, 3 Drawing Sheets

LED CONTROL CIRCUIT AND METHOD THEREFOR

BACKGROUND OF THE INVENTION

The present invention relates, in general, to electronics, and more particularly, to methods of forming semiconductor devices and structure.

In the past, the semiconductor industry utilized various methods and structures to form driver circuits for light emitting diodes (LEDs). Some of the LED driver circuits were designed to received an analog control signal and generate an analog drive signal that linearly varied the current through the LED. One example of such a control circuit that was available from Fairchild Semiconductor Corp. of South Portland Me. was referred to by the part number FAN5611. In some applications, it was desirable to have other methods of controlling the current through the LED.

Accordingly, it is desirable to have an LED controller that can vary the current through an LED in more than one method in response to a control signal.

For simplicity and clarity of the illustration, elements in the figures are not necessarily to scale, and the same reference numbers in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, a person of ordinary skill in the art will appreciate that complementary devices are also possible in accordance with the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action.

DETAILED DESCRIPTION OF THE DRAWINGS

Figure 1:
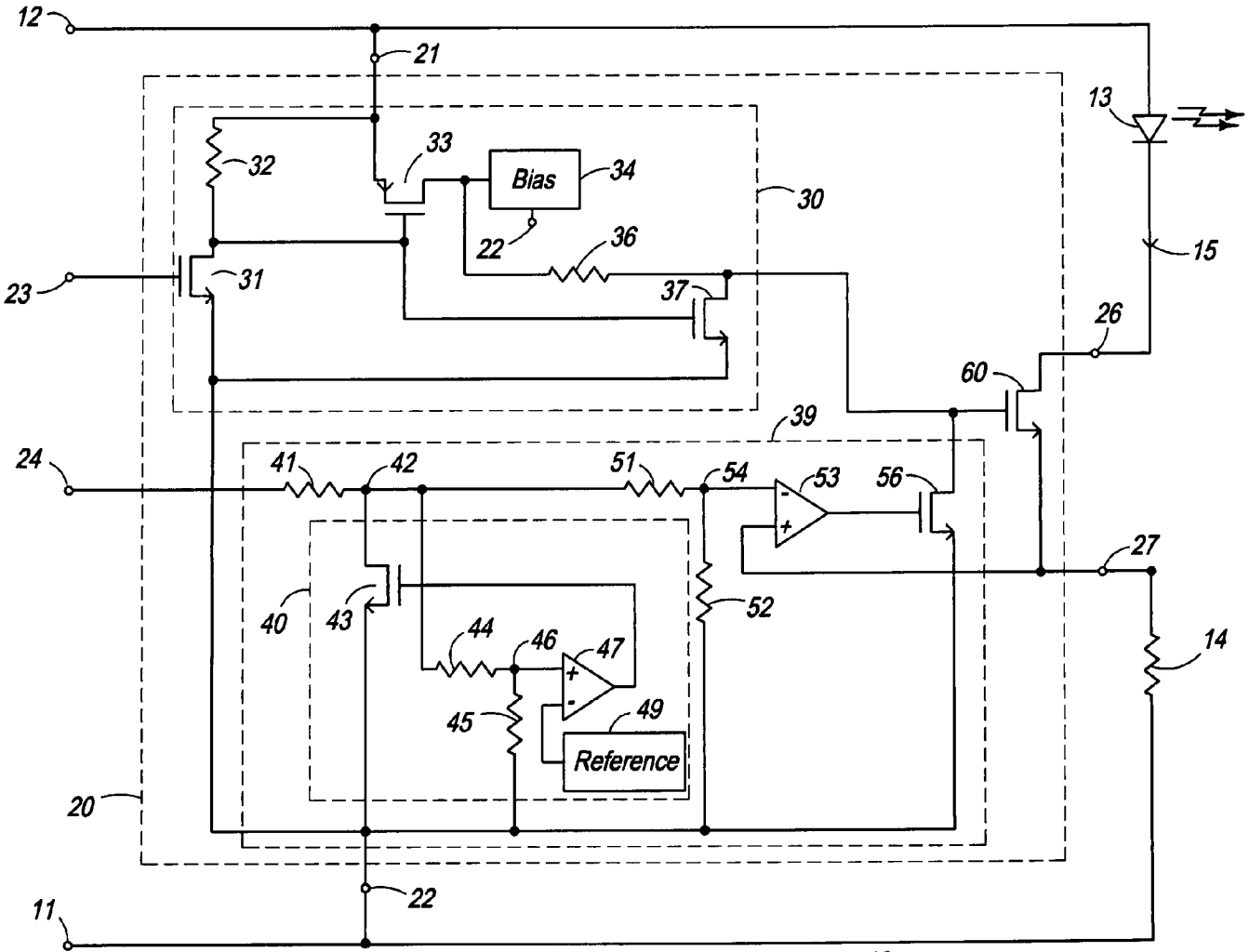
FIG. 1 schematically illustrates an embodiment of a portion of an LED system having an LED controller in accordance with the present invention.

FIG. 1 schematically illustrates an embodiment of a portion of an LED lighting system 10 that includes an exemplary form of an LED controller 20. LED controller 20 is configured to control an LED current 15 through an LED 13 to a value that is proportional to a control signal for values of the control signal that are less than a threshold value of the control signal and to control current 15 to a value that is proportional to the threshold value for values of the control signal that are no less than the threshold value. System 10 receives power from an input voltage, such as a DC input voltage from a battery or other dc voltage source, between a power input terminal 12 and a power return terminal 11. LED current 15 is controlled by controller 20 and flows through LED 13 in order for LED 13 to generate light. Current 15 also usually flows through a sense resistor 14 is used to form a sense signal that is representative of the value of current 15. Using a resistor that is external to controller 20 allows using different resistor values to provide different values for current 15.

Controller 20 includes a voltage input 21 and a voltage return 22 that typically are connected to respective terminals 12 and 11 to receive power for operating controller 20. Controller 20 also has a control input 24, a current output 26, and a sense input 27. In some embodiments, controller 20 may also have an enable input 23 that is used for enabling and disabling the operation of controller 20. Controller 20 may include an enable circuit 30, a control circuit 39, and a pass element, such as an output transistor 60. Control circuit 39 generally includes a limiter circuit 40, a amplifier 53, a voltage divider formed by resistors 51 and 52, a buffer resistor 41, and a control switch or transistor 56. As will be seen further hereinafter, limiter circuit 40 is configured to detect the control signal reaching a threshold value of the control signal and responsively inhibit increasing the value of current 15, thereby keeping the value of current 15 substantially constant, for values of the control signal that are greater than the threshold value.

Enable input 23 receives an enable signal that goes high to enable the operation of controller 20. The high from input 23 enables transistor 31 which pulls the gate of transistors 33 and 37 low to enable transistor 33 and disable transistor 37. Enabling transistor 33 couples bias circuit 34 to receive power and begin supplying bias currents to the other elements of controller 20. The bias currents generated by bias circuit 34 are used to supply an operating bias current to enable the operation of the other elements of controller 20, such as circuit 39.

Figure 2:
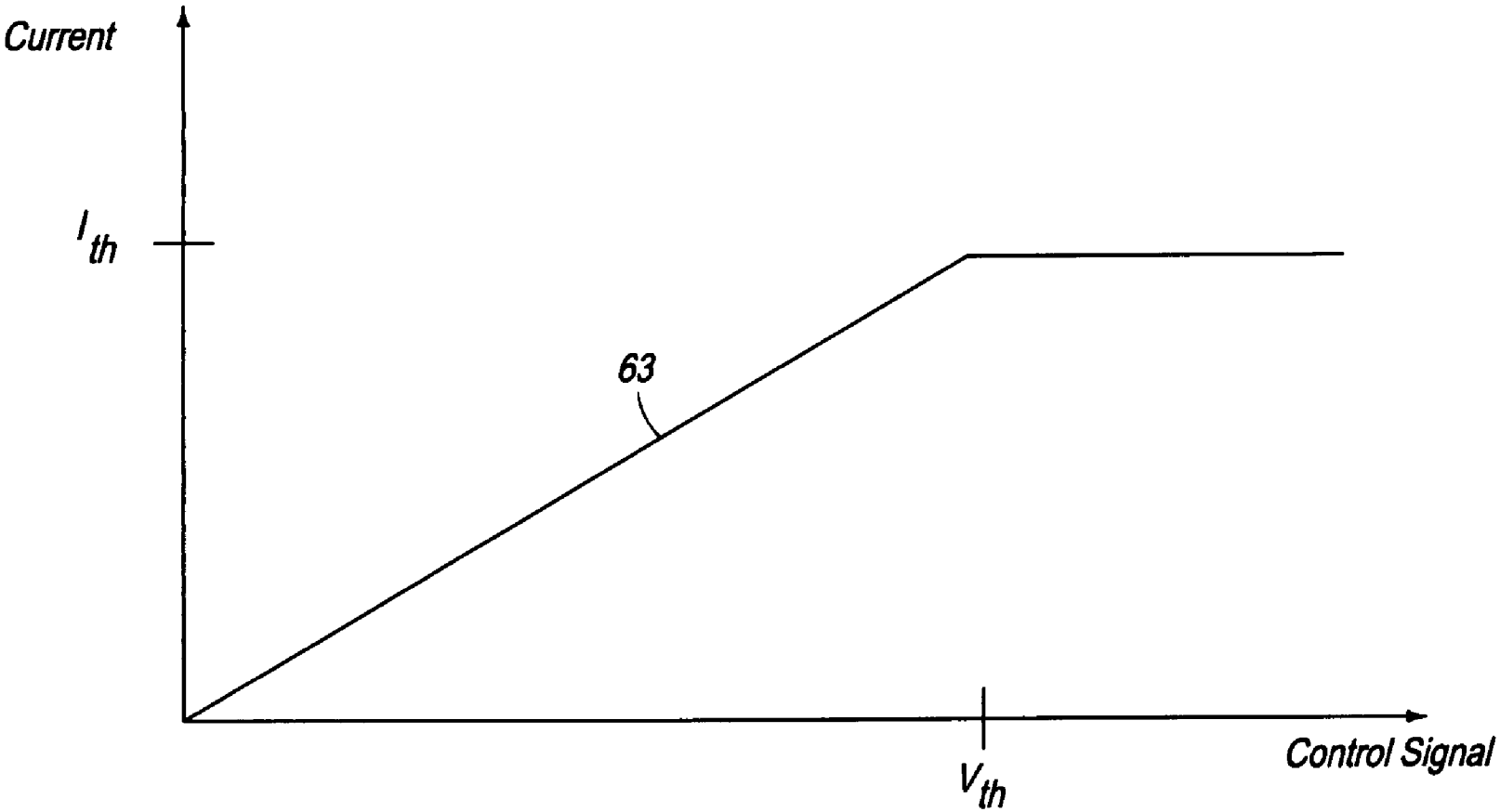
FIG. 2 is a graph illustrating a signal of the LED system of FIG. 1 in accordance with the present invention.

FIG. 2 is a graph having a plot 63 illustrating current 15 for values of the control signal received on input 24. The abscissa indicates increasing value of the control signal and the ordinate indicates increasing value of current 15. Circuit 39 is configured to form a drive signal to drive LED 13 proportionally to a value of the control signal for control signal values that are no greater than a threshold value, as illustrated by plot 63 between the axes intersection and point Vth, and to maintain current 15 at a substantially constant value for values of the control signal that are greater than the threshold value, as illustrated by plot 63 to the right of point Vth. Controller 20 receives the control signal on control input 24. Resistor 41 separates input 24 from an internal node 42 and forms a first signal on node 42 that is representative of the value of the control signal. The voltage divider of resistors 51 and 52 receives the first signal from node 42 and forms a second signal on a node 54 that is proportional to the value of the control signal, thus, representative of the value of the control signal. For control signal values that are no greater than the threshold value (Vth), the value of the first signal on node 42 and the value of the second signal on node 54 vary proportionally to variations of the control signal. Amplifier 53 forms the drive signal on the output of amplifier 53 that is representative of the difference between the second signal on node 54 and the sense signal received on input 27. As the value of the second signal on node 54 becomes less than the sense signal, the output of amplifier 53 increases thereby increasing the value of current 15. As the value of the second signal on node 54 becomes greater than the sense signal, the output of amplifier 53 increases thereby increasing the value of current 15.

Limiter circuit 40 is configured to detect the control signal reaching the threshold value (Vth) and responsively inhibit increasing the value of current 15, thereby keeping the value of current 15 substantially constant at a corresponding threshold current (Ith) formed by the threshold value of the control signal. Circuit 40 maintains current 15 substantially constant for values of the control signal that are greater than the threshold value (Vth) of the control signal. The exemplary embodiment of limiter circuit 40 illustrated in FIG. 2 includes a resistor divider formed by resistors 44 and 45, an amplifier 47, a reference generator or reference 49, and another pass element, such as a transistor 43. As the value of the control signal on input 24 reaches the threshold value, the value of the first signal on node 42 also reaches substantially the threshold value. The resistor divider of resistors 44 and 45 forms a third signal on a node 46 that is representative of the value of the first signal, thus, representative of the threshold value. Reference 49 is configured to generate a reference signal on the inverting input of amplifier 47 that is approximately equal to the value of the third signal formed at node 46 by the resistor divider of resistors 41, 44, and 45 for the corresponding threshold value of the control signal minus the threshold voltage of transistor 43. When the control signal on input 24 reaches the threshold value (Vth), the third signal on node 46 reaches the value of reference 49 which increases the value of the output of amplifier 47 to a value that enables transistor 43. As the value of the control signal increases past the threshold value, the output of amplifier 47 increases to further enable transistor 43 and keep the value of the first signal from increasing thereby keeping the value of the first signal substantially at the threshold value. Resistor 41 buffers the control signal on input 24 from the effect of transistor 43. As a result, the value of the second signal received by amplifier 53 is prevented from increasing to a value that is greater than the value corresponding to the threshold value thereby preventing current 15 from increasing. Even if the value of the control signal on input 24 increases above the threshold value, circuit 40 prevents the first and second signals from increasing past the values corresponding to the threshold value, thereby preventing current 15 from increasing past the current value (Ith) that corresponds to the threshold value (Vth) of the control signal.

Because of the dual control functionality of input 24, controller 20 may be used to control current 15 responsively to an analog signal applied to input 24 or responsively to a digital signal, such as a PWM signal, applied to input 24. For example, an analog signal that varies between the value of return 22 and the threshold voltage of the control signal can be used to control current 15 in an analog manner responsively to values of the control signal. Thus, the analog value of the control signal controls the value of current 15 and the brightness of LED 13 in an analog manner. Also, a digital signal that varies between the value of return 22 and a value that is greater than the threshold value of the control signal can be used to control current 15 in a digital manner. At the low value of the digital control signal, current 15 may be substantially zero and at the high value of the control signal, current 15 will be at a maximum value, thus, the brightness of LED 13 will vary in a digital manner between substantially no light and a maximum amount of light. The duty cycle of the digital control signal may be used to control the average value of current 15 and brightness of LED 13. As can be seen, a pulse width modulated (PWM) signal can be used to digitally vary current 15 and the light intensity of LED 13. Such control functionality facilitates obtaining similar values of current 15, thus light intensity of LED 13, for both analog control signals and PWM control signals. For example, an analog signal that is approximately half way between the value of return 22 and the threshold value provides a current 15 value and corresponding light intensity that is approximately one-half of the maximum value. A similar light intensity may be obtained by a PWM control signal that has an approximately fifty percent duty cycle.

In order to implement this functionality for controller 20, input 24 is connected to a first terminal of resistor 41 which has a second terminal connected to node 42. A first terminal of resistor 51 is connected to node 42 and a second terminal and is commonly connected to the inverting input of amplifier 53 and a first terminal of resistor 52. A second terminal of resistor 52 is connected to return 22. A first terminal of resistor 44 is connected to node 42 and a second terminal is commonly connected to the non-inverting input of amplifier 47 and to a first terminal of resistor 45. A second terminal of resistor 45 is connected to return 22. The inverting input of amplifier 47 is connected to the output of reference 49. The output of amplifier 47 is connected to a gate of transistor 43 which has a drain connected to node 42 and a source connected to return 22. The non-inverting input of amplifier 53 is connected to input 27 and to the source of transistor 60. The output of amplifier 53 is connected to a gate of transistor 56. A drain of transistor 56 is commonly connected to a gate of transistor 60 and the output of bias circuit 34 through a resistor 36. A source of transistor 56 is connected to return 22. A drain of transistor 60 is connected to output 26. Although transistor 43 is illustrated coupled to the reference signal from return 22, it will be appreciated that transistor 43 may be coupled to any reference signal that has a value that is less than the value of the third signal corresponding to the threshold value of the control signal. Those skilled in the art will appreciate that transistor 60 may be external to controller 20 in some embodiments. Additionally, it will be appreciated by those skilled in the art that controller 20 may be used to control any other current operated device in addition to LED 13.

Figure 3:
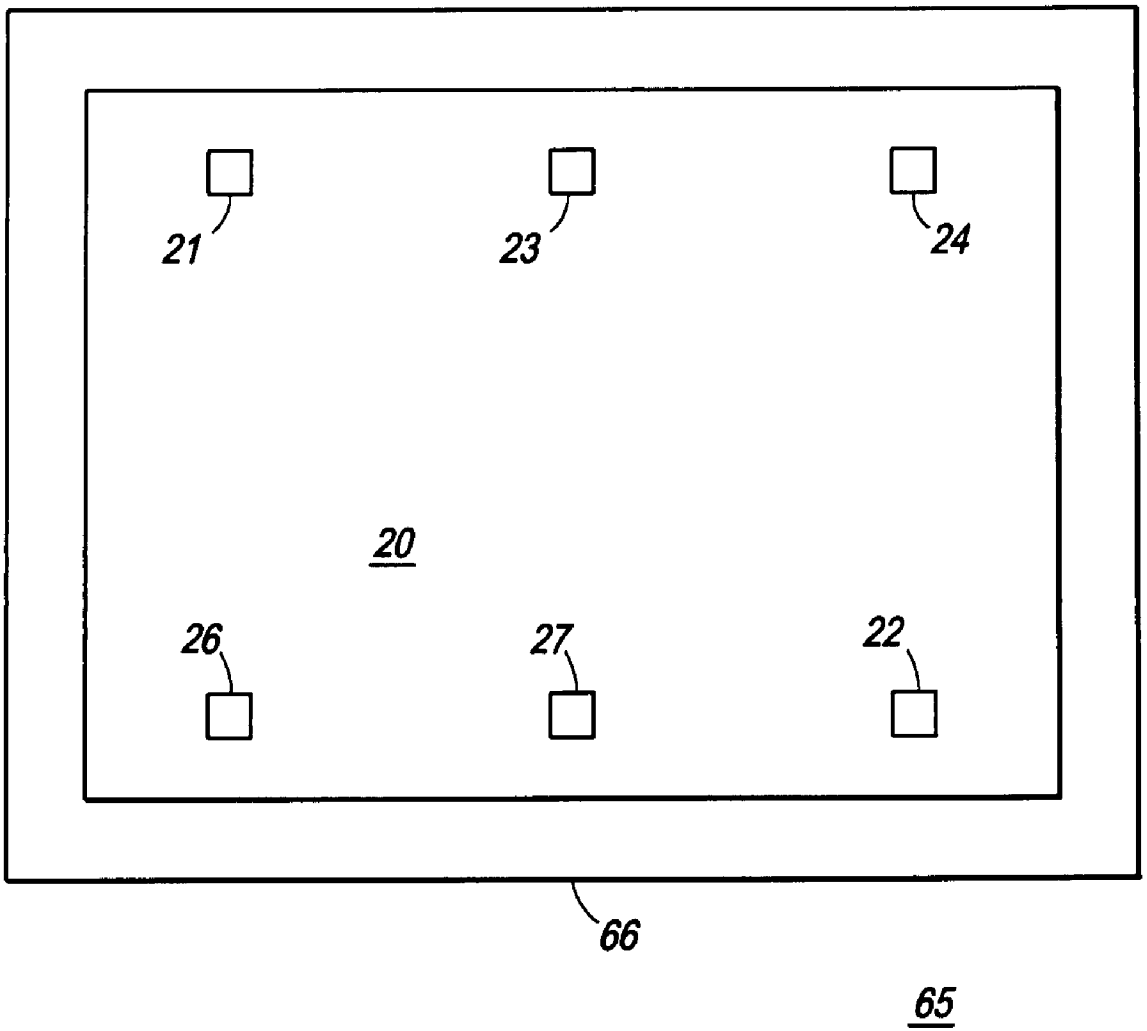
FIG. 3 illustrates an enlarged plan view of a semiconductor device that includes the LED controller of FIG. 1 in accordance with the present invention.

FIG. 3 schematically illustrates an enlarged plan view of a portion of an embodiment of a semiconductor device or integrated circuit 65 that is formed on a semiconductor die 66. Controller 20 is formed on die 66. Die 66 may also include other circuits that are not shown in FIG. 3 for simplicity of the drawing. Controller 20 and device or integrated circuit 65 are formed on die 66 by semiconductor manufacturing techniques that are well known to those skilled in the art. In one embodiment, controller 20 is formed on a semiconductor substrate as an integrated circuit having six external leads as shown by lead connections for output 26, return 22, and inputs 21, 23, 24, and 27.

In view of all of the above, it is evident that a novel device and method is disclosed. Included, among other features, is forming a controller that keeps the output current constant as the control signal increases past a threshold value.

While the subject matter of the invention is described with specific preferred embodiments, it is evident that many alternatives and variations will be apparent to those skilled in the semiconductor arts. For example, although transistor 43 is illustrated coupled to the reference signal from return 22, it will be appreciated that transistor 43 may be coupled to any reference voltage that has a value that is less than the threshold value. Additionally, limiter circuit 40 may have other implementations as long as the limiter circuit inhibits increasing current 15 after the control signal reaches the threshold value. Additionally, the word "connected" is used throughout for clarity of the description, however, it is intended to have the same meaning as the word "coupled". Accordingly, "connected" should be interpreted as including either a direct connection or an indirect connection.

The invention claimed is:

1. An LED control circuit comprising:

an input configured to receive a control signal having a control value for setting an intensity of an LED wherein the control value varies from a first value to a second value and has a threshold value that is less that the second value and greater than the first value; and an output configured to form a current through an LED;

the LED control circuit configured to vary the current responsively to the control value of the control signal as the control value varies from the first value to no greater than the threshold value, the LED control circuit configured to detect the control value reaching the threshold value and responsively control the current to be substantially constant and proportional to the threshold value for control values of the control signal that are greater than the threshold value, wherein the LED control circuit does not change the control value.

2. The LED control circuit of claim 1 further including a sense input coupled to receive a sense signal that is representative of a current through the LED.

3. The LED control circuit of claim 2 further including an amplifier coupled to compare a first signal that is representative of the control signal to the sense signal and control the value of the current responsively to the control value.

4. The LED control circuit of claim 1 wherein the LED control circuit is configured to receive the control signal and form a first signal that is representative of the control signal, the LED control circuit including an amplifier coupled to compare the first signal to a reference signal and to inhibit increasing a value of the first signal for values of the control signal that are greater than the threshold value, the amplifier having an output.

5. The LED control circuit of claim 4 further including a resistor divider coupled to receive the control signal and form the first signal that is representative of the control signal.

6. The LED control circuit of claim 4 further including a transistor having a control electrode coupled to receive the output of the amplifier and clamp the first signal to a value not exceeding the threshold value, the transistor having first and second current carrying electrodes.

7. The LED control circuit of claim 6 wherein the first current carrying electrode of the transistor is coupled to receive the control signal and the second carrying electrode of the transistor is coupled to a voltage return.

8. The LED control circuit of claim 1 wherein the LED control circuit is formed on a single semiconductor die wherein the input and the output are coupled to terminals on the semiconductor die.

9. A method of forming an LED control circuit comprising:

configuring an input of the LED control circuit to receive a control signal; and configuring the LED control circuit to control a current through an LED to a value that is proportional to a value of the control signal for values of the control signal that are less than a threshold value of the control signal and to control the current to a substantially constant value that is proportional to the threshold value for values of the control signal that are no less than the threshold value.

10. The method of claim 9 wherein configuring the LED control circuit includes configuring the control circuit to receive a sense signal that is representative of the current and control the current responsively to the sense signal and the control signal.

11. The method of claim 9 wherein configuring the LED control circuit includes configuring a limiting circuit to prevent increasing a value of the current for control signal values that are no less than the threshold value of the control signal.

12. The method of claim 11 wherein configuring the limiting circuit to prevent increasing the value of the current includes configuring the LED control circuit to form a first signal that is representative of the control signal and configuring the limiting circuit to prevent the first signal from increasing responsively to receiving the threshold value of the control signal.

13. The method of claim 12 wherein configuring the limiting circuit to prevent the first signal from increasing includes coupling an amplifier to form an error signal that is representative of a difference between the first signal and a reference signal that is representative of the threshold value.

14. The method of claim 13 further including coupling a transistor to receive the error signal and control a value of the first signal to a value that is no greater than the threshold value.

15. The method of claim 12 wherein configuring the LED control circuit includes coupling an amplifier to receive the first signal and form the current responsively to the first signal.

16. A current control circuit comprising:

a first input configured to receive a control signal having a control value for setting an intensity of an LED wherein the control value varies from a first value to a second value and has a threshold value that is less that the second value and greater than the first value;

an amplifier having a first input coupled to receive a first signal that is representative of the control signal, a second input coupled to receive a first reference signal, and an output; and a transistor having a first current carrying electrode coupled to receive the first signal, a second current carrying electrode coupled to a second reference signal that is less than the first reference signal, and a control electrode coupled to receive the output of the amplifier wherein the amplifier disables the transistor for control values that are less than the threshold value and enables the transistor for control values that are greater than the threshold value.

17. The current control circuit of claim 16 further including a second input configured to receive a sense signal that is representative of a current through an LED and a second amplifier coupled to receive the first signal and a second input coupled to receive the sense signal, and an output coupled to form a drive signal for controlling the current through the LED.

18. The current control circuit of claim 16 further including a resistor coupled to receive the control signal and form the first signal.

* * * * *